United States Patent [19]

Drake

[11] Patent Number: 4,585,398

[45] Date of Patent: Apr. 29, 1986

[54] COMBINATION FLUID TANK, AIR/FLUID COOLER AND PRIME MOVER/PUMP MOUNTING SYSTEM FOR A HYDRAULIC POWER UNIT

[76] Inventor: Maurice D. Drake, 3751 Woodman, Troy, Mich. 48084

[21] Appl. No.: 638,947

[22] Filed: Aug. 8, 1984

[51] Int. Cl.[4] ..... F04B 39/06

[52] U.S. Cl. ..... 417/367; 417/372

[58] Field of Search ..... 417/368, 372, 367, 360, 417/359, 313, 362, 234, 231, 424, 199 R, 902

[56] References Cited

U.S. PATENT DOCUMENTS

| | | | |
|---|---|---|---|
| 1,491,989 | 4/1924 | Kettering | 417/424 |
| 2,083,582 | 6/1937 | Taylor et al. | 417/234 |
| 2,154,559 | 4/1939 | Bilde | 417/424 |
| 2,236,244 | 3/1941 | Cornelius | 417/372 |
| 3,487,431 | 12/1969 | Forkner | 417/372 |
| 3,791,766 | 2/1974 | Kikutsugi et al. | 417/372 |
| 3,802,804 | 4/1974 | Zimmermann | 417/360 |
| 3,982,856 | 9/1976 | Hehl | 417/360 |
| 3,994,624 | 11/1976 | Plunkett et al. | 417/360 |
| 4,172,697 | 10/1979 | Schoen | 417/372 |
| 4,302,160 | 11/1981 | Hofmann, Jr. | 417/313 |
| 4,324,533 | 4/1982 | Schroeder et al. | 417/360 |

*Primary Examiner*—Cornelius J. Husar
*Assistant Examiner*—Peter M. Cuomo
*Attorney, Agent, or Firm*—Lyman R. Lyon

[57] ABSTRACT

A combination fluid tank, air/fluid cooler, and mounting system for the prime mover and pump of a hydraulic power unit comprises a tank having a pair of spaced parallel laterally aligned prime mover and pump mounting plates on opposite walls thereof with a torsion tube connecting the mounting plates. A fan induces a flow of air internally of the torque tube providing for cooling of fluid in the tank. Efficient cooling in combination with a deaerating compartment within the tank minimizes the size of the tank.

6 Claims, 3 Drawing Figures

COMBINATION FLUID TANK, AIR/FLUID COOLER AND PRIME MOVER/PUMP MOUNTING SYSTEM FOR A HYDRAULIC POWER UNIT

BACKGROUND OF THE INVENTION

Hydraulic power units normally comprise a prime mover, for example, an electric motor, gasoline or diesel engine, a pump, fluid tank, control valves, cooler, filters, etc.

The prime mover/pump assembly requires special shaft alignment and shimming and is usually built upon a machined base, which is mounted on, under, or beside the fluid tank. In prior art systems, the fluid tank is normally sized so that its fluid volume is three times the pump flow rate. As a result, such known tanks are large and expensive and require two to three times the floor space that the prime mover/pump assembly alone requires.

SUMMARY OF THE INVENTION

The mounting system of the instant invention provides for: (1) relatively efficient and compact mounting of the prime mover and the pump, (2) a built-in air/fluid cooling system, (3) a deaeration system, and (4) efficient fluid storage. The assembled power unit is one-third to one-fifth the size of power units currently on the market, the complete assembly requiring less than 5% more floor space than the prime mover/pump assembly alone. A significant feature is that the ratio between tank volume and the pump flow is reduced from 3:1 to 1:1.

The width of the fluid tank is established by the length of the prime mover and the pump shafts and the coupling spacing requirement. Two mounting flanges, one for the prime mover and one for the pump are first machined then welded into the sides of the tank. The flanges are thereafter line bored to assure precise shaft alignment. A large diameter torque tube interconnects the two flanges and absorbs the reaction torque between the prime mover and pump. Thus, the tank assembly provides mounting flanges for the prime mover and pump, automatically establishes good shaft alignment and requires virtually no additional floor space.

The torque tube acts also as an interface for a built-in air/fluid cooler. Hot fluid that has been returned to the tank transfers its heat to the cool torque tube as it flows over and around the outside surface of the torque tube. The inside surface of the torque tube is cooled by a steady flow of cool air, which picks up the heat from the torque tube and transfers it away from the tank.

DETAILED DESCRIPTION OF THE PREFERRED EMBODIMENT OF THE INVENTION

Figure 1:
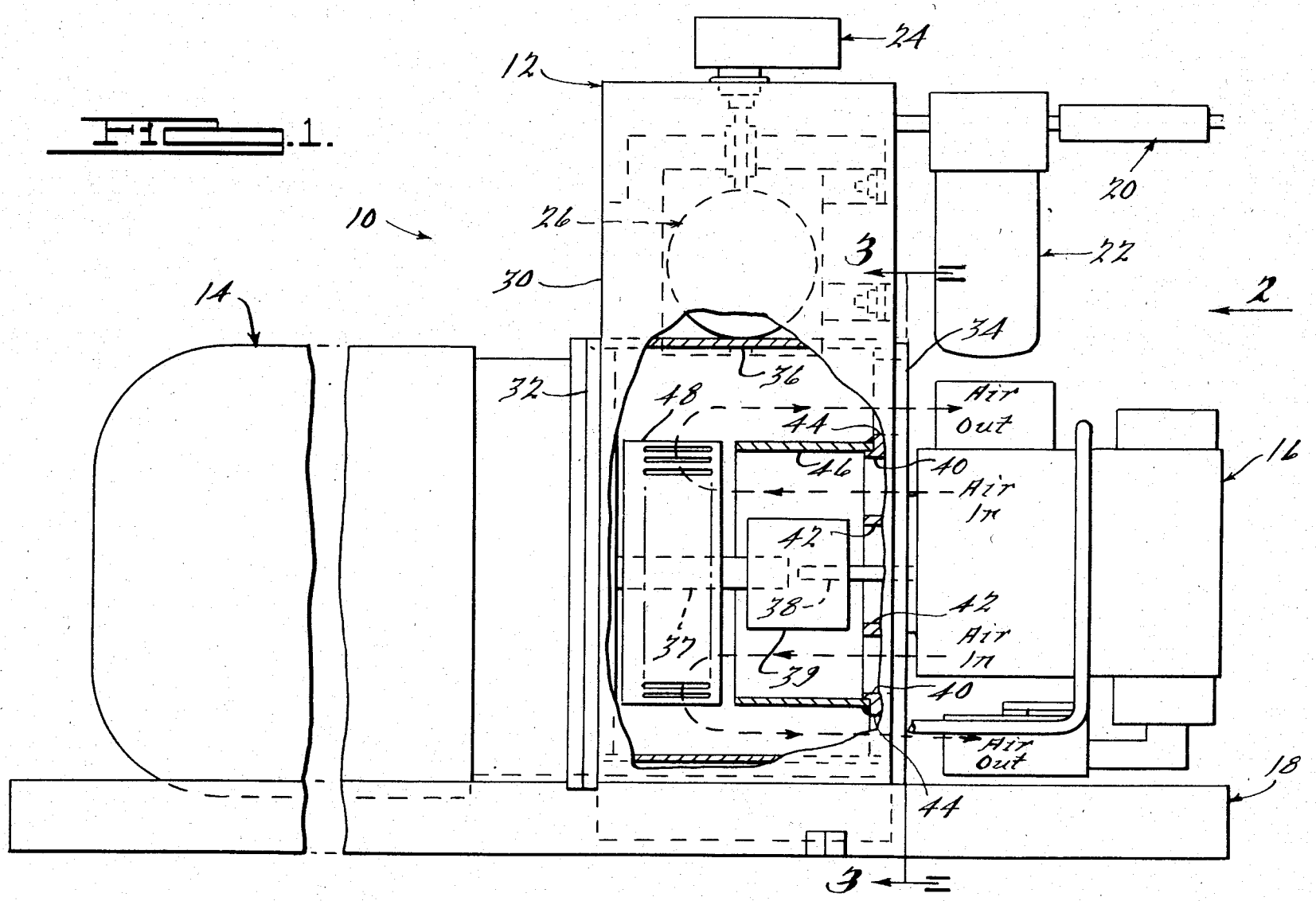
FIG. 1 is a side elevational view, partially broken away, of the combination oil tank and mounting system of the instant invention.

Referring to FIG. 1 of the drawing, a hydraulic power unit 10 comprises a combination fluid tank and mounting system 12 for the support of, for example, an electric motor 14 and hydraulic pump 16. The tank 12 is secured to a combination base member and drip pan 18. The power unit 10 is provided with a conventional external check valve 20 and filter 22. The tank 12 is provided with a conventional float switch 24 and internal float 26.

In accordance with the instant invention, the combination oil tank and mounting system 12 comprises a generally rectangular enclosure 30 which may be a casting or a weldment. The enclosure 30 is provided with a pair of mounting plates 32 and 34 for face mounting of the motor 14 and pump 16, respectively.

In accordance with one feature of the instant invention, a torque tube 36 extends from the mounting plate 32 internally of the enclosure 30 to the mounting plate 34 thereby to serve the dual function of absorbing reaction torque between the motor 14 and pump 16 as well as providing a relatively large cylindrical surface for conductive cooling of oil internally of the tank 30. A motor drive shaft 37 is connected to a coaxially related pump drive shaft 38 by a flexible coupling 39.

In accordance with another feature of the instant invention, the mounting plate 34 is provided with a plurality of air inlet apertures 40 spaced radially outwardly of a drive shaft aperture 42. The mounting plate 34 is also provided with a plurality of air outlet apertures 44 spaced radially outwardly of the inlet apertures 40 and separated therefrom by a baffle tube 46 which extends inwardly of the mounting plate 34 into close proximate relation to a fan 48 mounted on the drive shaft 37 of the motor 14. The fan 48 draws air axially inwardly through the apertures 42 in the mounting plate 34, then forces the air radially outwardly to the torque tube 36 and thence axially outwardly through the apertures 44 in the plate 34 effecting cooling of the internal surface of the torque tube 36 and thus, cooling the fluid disposed externally thereof within the tank 30.

Figure 2:
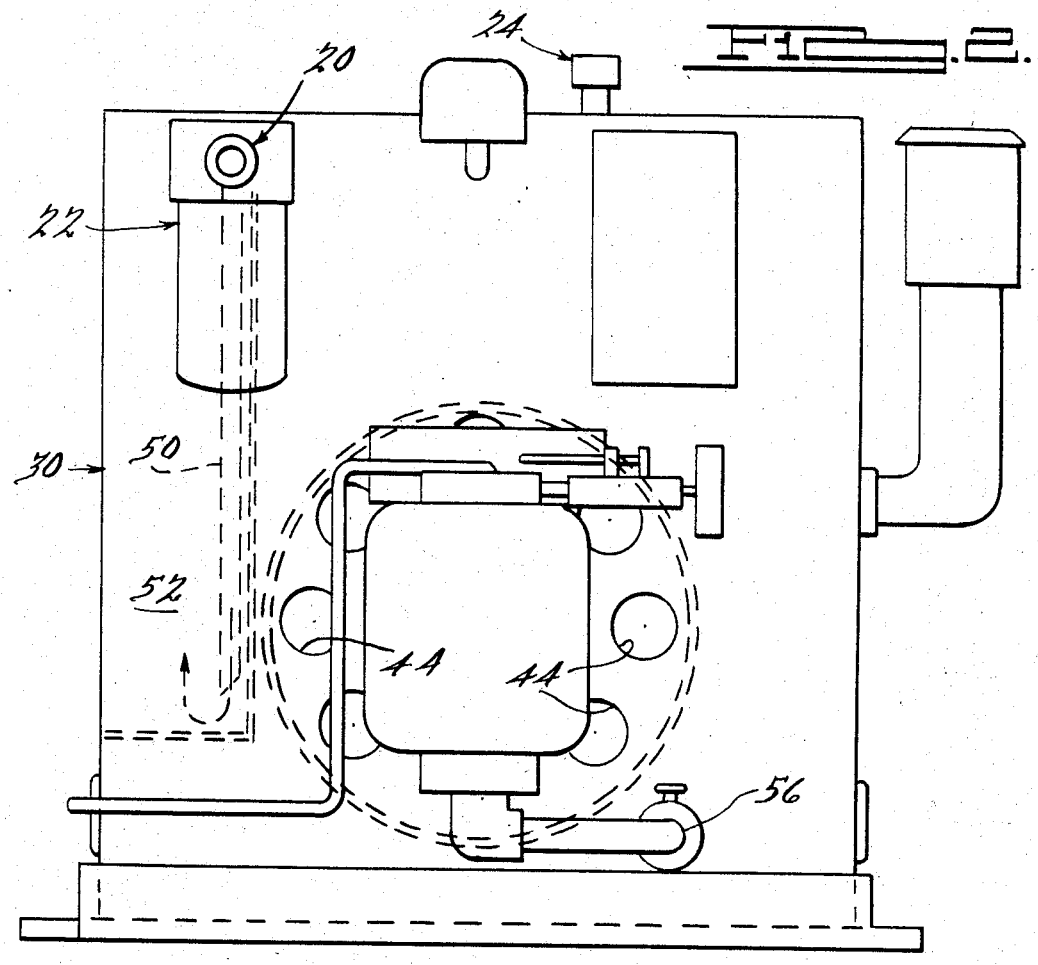
FIG. 2 is an elevational view taken in the direction of arrow 2 of FIG. 1.
Figure 3:
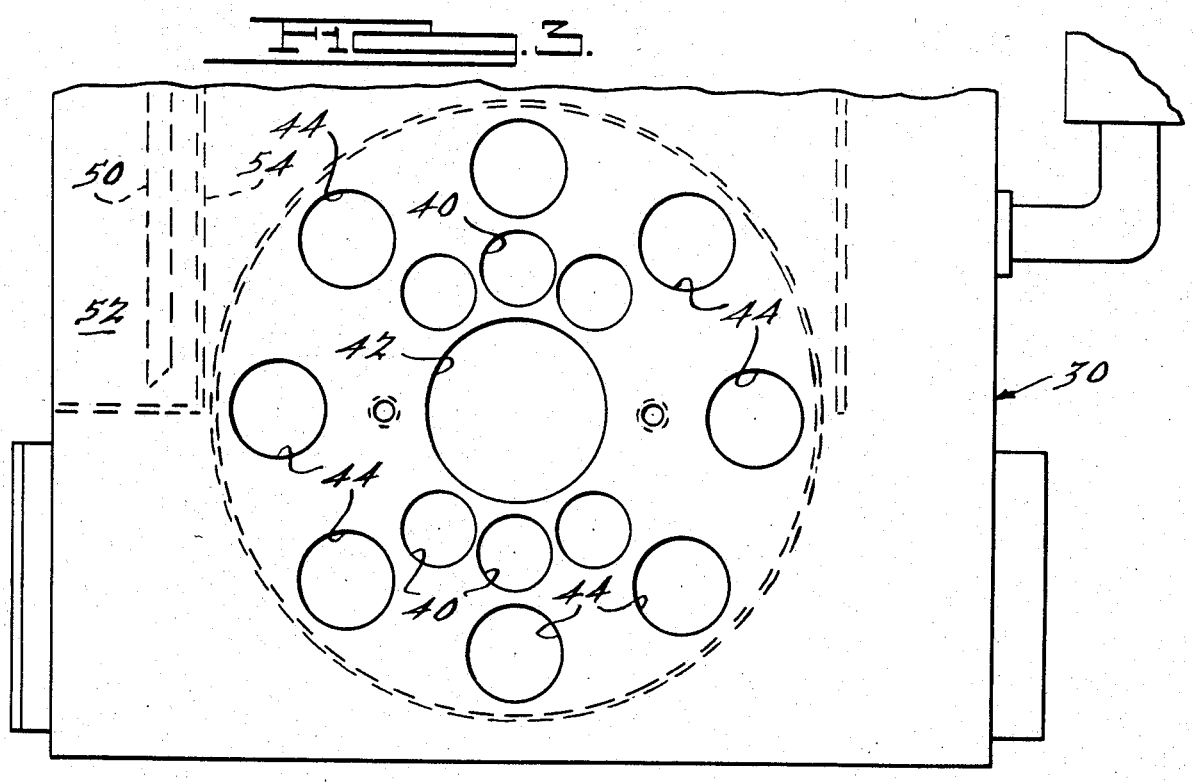
FIG. 3 is a cross sectional view taken along the line 3—3 of FIG. 1.

In accordance with yet another feature of the instant invention, as best seen in FIGS. 2 and 3, oil is returned to the tank 30 through a downwardly extending tube 50 that terminates at the lower end of a deaerating compartment 52 defined by a baffle plate 54. Upward flow of fluid is induced hydraulically within the chamber 52 which deaerates the fluid as it flows over the baffle 54, about the tube 36 to a discharge outlet 56 thereby minimizing the volume requirement of the tank 30.

From the foregoing description, it should be apparent that the instant invention provides for compact mounting of both the prime mover and pump of a power unit. The mounting provides for the acceptance of the relatively heavy torsional loads induced by the motor and pump in a minimum of space.

The cooling air flow is developed by a blower wheel that is driven by the prime mover. The air flows axially inwardly then radially outwardly to cool the inner surface of the torque tube, then out of the system. The air is ported in and out of the cooler through ports machined into the pump mounting flange. As a result, a 10 gallon tank in accordance with the instant invention can remove the same amount of heat as a conventional 60 gallon tank.

The tank baffle system assures that the fluid is deaerated before it is returned to the pump. The system hydraulically lifts fluid having entrained air bubbles to the surface of the fluid in the tank which allows the bubbles to escape before the fluid is returned to the pump. In this manner, the tank of the instant invention can deaerate fluid up to four times faster than a conventional tank.

While the preferred embodiment of the invention has been disclosed, it should be appreciated that the invention is susceptible of modification without departing from the scope of the following claims.

I claim:

1. A combination fluid tank, air/fluid cooler, and mounting system for a prime mover and a pump of a hydraulic power unit comprising a tank having a pair of spaced, parallel, laterally aligned mounting plates on opposite walls thereof, an imperforate reaction torque tube extending between the opposite walls of said tank in fluid sealed relationship to the interior thereof whereby fluid in said tank is in direct heat transfer contact with one surface of said tube, said tube being mechanically connected to said mounting plates in reaction torque transmitting relationship, a prime mover mounted on one of said mounting plates and having a rotary output shaft extending internally of said reaction torque tube and toward the other of said mounting plates, and a pump mounted on the other of said mounting plates and having a rotary input shaft drivably connected to the output shaft of said prime mover.

2. A combination fluid tank, air/fluid cooler, and mounting system in accordance with claim 1 including a fan mounted on one of said shafts, an air inlet aperture in one of said mounting plates, and means internally of said torque tube providing an air outlet aperture so as to induce air flow air internally of said torque tube to cool fluid in said tank.

3. A combination fluid tank, air/fluid cooler, and mounting system in accordance with claim 2 wherein said inlet aperture and air outlet aperture are in one of said mounting plates.

4. A combination fluid tank, air/fluid cooler, and mounting system in accordance with claim 2 wherein said air inlet and air outlet apertures are in said pump mounting plate.

5. A combination fluid tank, air/fluid cooler, and mounting system in accordance with claim 2 wherein a shroud extends axially of said torque tube betwen said air inlet aperture and said air outlet aperture to segregate air flow therebetween.

6. A combination fluid tank, air/fluid cooler, and mounting system in accordance with claim 1 including a fluid outlet in said tank at the bottom thereof, a discrete deaerating compartment in said tank having an open upper end portion, and an inlet tube having a fluid discharge opening at the lower end of said deaerating compartment, said compartment functioning as a baffle over which fluid must flow in order to reach said fluid outlet.

* * * * *